United States Patent [19]

Morane

[11] 4,154,369

[45] May 15, 1979

[54] NON-REFILLABLE DISPENSING CONTAINER

[75] Inventor: Bruno P. Morane, Paris, France

[73] Assignee: L'Oreal, Paris, France

[21] Appl. No.: 865,709

[22] Filed: Dec. 29, 1977

[30] Foreign Application Priority Data

Jan. 19, 1977 [FR] France ..... 77 01430

[51] Int. Cl.[2] ..... B65D 49/12

[52] U.S. Cl. ..... 222/147; 222/382; 215/16

[58] Field of Search ..... 222/147, 321, 322, 372, 222/378, 382, 383, 385, 464, 563, 568; 239/333, 331; 215/14, 16; 220/214

[56] References Cited

U.S. PATENT DOCUMENTS

| | | | |
|---|---|---|---|
| 3,187,960 | 6/1965 | Gorman | 222/383 X |
| 3,228,571 | 1/1966 | O'Donnell et al. | 222/385 X |
| 3,865,313 | 2/1975 | Kondo | 222/383 X |

FOREIGN PATENT DOCUMENTS

| | | | |
|---|---|---|---|
| 1166425 | 3/1964 | Fed. Rep. of Germany | 222/383 |

*Primary Examiner*—Joseph J. Rolla
*Assistant Examiner*—Edward M. Wacyra
*Attorney, Agent, or Firm*—Brisebois & Kruger

[57] ABSTRACT

A non-refillable dispensing container, the product in which is dispensed by a removable dispensing pump. A connector fixed in the container neck includes a fitting connecting the inlet of the pump to the interior of the container to dispense the liquid product when the pump is operated. When the pump is removed, the connector blocks the container neck against practicable refilling.

19 Claims, 6 Drawing Figures

NON-REFILLABLE DISPENSING CONTAINER

SUMMARY OF THE INVENTION

The present invention relates to a device for storing and dispensing a liquid product.

It is known that, in order to avoid atmospheric dispersion or pollution of the atmosphere with gases used as propellants for the "aerosol bomb" type of container, non-pressurized containers may be used in which the dispensing of the product from the container is effected manually. For dispensing a liquid product, a manual pump may conveniently be used whose push button is reciprocated by the user's finger to eject the liquid product to be dispensed, as a spray or stream.

Manual ejection pumps are well known and it has been found that they function properly for a very large number of working strokes, this number being far higher than required for dispensing all of the liquid product contained in the usual sizes of container. For reasons of economy the possibility of re-using the manual pump after depletion of the product from the container with which it has been associated, has been considered.

To make such re-use possible the pump must be easily separable from the container with which it cooperates. This separation may, for instance, be effected by unscrewing a threaded female part of a cap integral with the pump, from a threaded male part carried by the container neck with which the cap and its associated pump cooperate. The drawback of such an arrangement is that the container, from which the pump has been removed, may be easily refilled with any kind of product which does not correspond to markings or labels originally on the outside of the container. As a result, the re-use of a hand pump has so far been incompatible with regard to any safeguards to ensure, simply by inspection, that the user can always readily ascertain the nature of the product in the container.

The object of the present invention is to provide a container comprising, a detachable, re-usable dispensing hand pump, and fitted with a device which nevertheless essentially prevents re-use of the container after initial depletion of its contents. In this way, it is possible to reconcile both the economy resulting from the re-use of the pump, and the user's safety, because of the practical impossibility of refilling the depleted container.

According to the present invention, there is provided a device for storing and dispensing a liquid product, such device comprising: a container having a neck; a refill preventing connector fixed to the neck; and a dispensing pump removably mounted on the connector, wherein the connector is adapted to be connected to the pump inlet and to communicate the pump inlet with the interior of the container.

Advantageously the fixing of the connector to the container neck is such that the connector cannot be removed from the neck without damaging, permanently deforming, or destroying either the container or the connector, so it can no longer be used with the pump.

In a preferred embodiment, the connector fixed to the neck includes an air vent orifice of a small cross section for ensuring communication of the internal gas space of the container with the region where the pump is situated; the connector is in the shape of a cup or thimble and rests with its open end on the rim of the container neck; the thimble-shaped connector comprises, at its closed inner end a fitting, one part of which projects upwardly into the thimble and the other part of which projects downwardly into the container, the two parts communicating with each other through the bottom wall of the thimble; the part of the fitting projecting into the thimble has an internal diameter which provides a force-fit with the free end of an inlet tube of the pump; the part of the fitting projecting into the container is fixed to the upper end of a dip tube which is thus connected to the pump inlet tube by the fitting. The connector is a piece of moulded plastics material having substantially the same length as the neck of which it forms an integral part and having as its side wall, a surface of revolution centered on the axis of the fitting with which the dip tube and the pump inlet tube cooperate; the pump is preferably integral with an internally threaded cap. The thread of the cap cooperates with a thread arranged on the outside of the container neck and can constitute means for mounting the pump removably on the connector.

In a first alternative embodiment, a collar at the upper open end of the connector is bonded to the free end of the neck, preferably by welding.

In a second alternative, the open end of the connector has a collar of a cross section widening in the direction towards said fitting, the said collar being capable of engaging in a corresponding groove formed on the inside of the neck near the rim of said neck.

In a third alternative, the open end of the connector includes a collar having a stirrup-shaped section, the collar overlapping the rim of the neck, the connector being maintained in position on the neck by the cooperation of an engaging flange and groove one of which is carried by the collar and the other by the rim of the neck.

In a fourth alternative, the open end of the connector forms a collar which is supported on the rim of the neck, by a retaining cap arranged externally on the connector and the neck.

In a fifth alternative, the neck takes the form of an internal sleeve integral with the container, and a neck cap fits over the neck, the open end of the connector having a collar which is gripped between a rim of the internal sleeve of the neck and the top part of the neck cap, the retaining of the collar being assured by the engagement of the neck cap on the internal sleeve of the neck; the neck cap including a means for fixing the pump on the outside of the neck, the fixing means preferably being a screw thread.

In a sixth alternative, the connector comprises a double-sided wall having coaxial internal and external shells which are interconnected along the open top end of the connector, the sleeve of the container neck being inserted between the two shells of the connector and being maintained therein by catch engagement; the outer shell of the side wall of the connector carries externally means for fixing the pump to the container; (such means for fixing the pump preferably being a male thread which cooperates with a corresponding female thread in the cap on which the pump is secured.)

It is clear that the container according to the invention allows the pump which is attached to the container to be easily detached, but the container, once separated from its pump, cannot practicably be refilled since the neck which has been exposed by removal of the pump is blocked against refilling by the connector therein. While this connector does not constitute a gas-tight barrier between the inside of the container and its outside, because of the communication between these two zones by the orifice through the fitting and air vent orifice communicating the inner gas space of the container with the exterior of the pump barrel; nevertheless, the orifices through the connector are of very small dimensions and will not in practice allow the container to be refilled. This avoids the risks which have existed until the present time when detachable hand pumps have been used.

In order that the present invention may more readily be understood, six embodiments thereof will now be described, purely by way of example, with reference to the accompanying drawings.

BRIEF DESCRIPTION OF THE DRAWINGS

FIGS. 1 to 6 showing respectively, different arrangements for securing to the container, a refill preventing connector which connects the pump to the container contents.

DETAILED DESCRIPTION OF PREFERRED EMBODIMENTS

Figure 4:
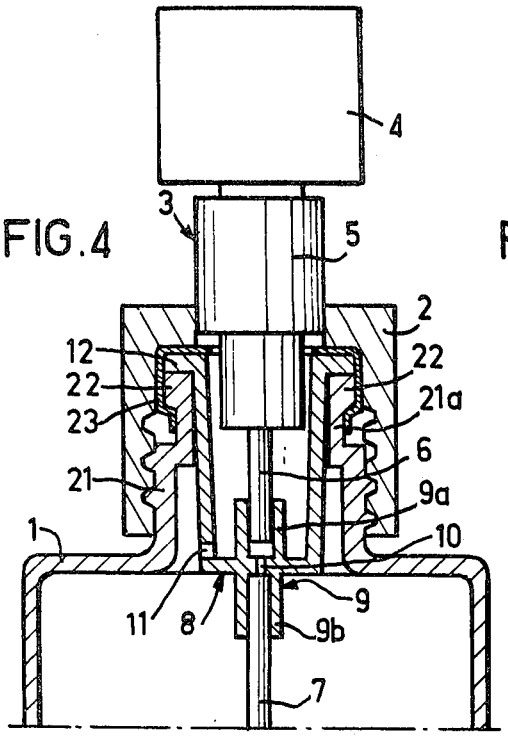
FIGS. 1 to 6 each show an axial cross section of the top part of a storaging and dispensing container according to the invention where a hand pump is threaded on the container.

On all the Figures the body of the container has been designated as 1. The body 1 comprises a neck which cooperates with an internally threaded cap 2 fixed coaxially to a manually operable ejection pump 3. Pump 3 has a displaceable push-button 4 connected with a pump barrel 5 to which is connected a suction tube 6. Suction tubing 6 provides for pumping the liquid to be dispensed from the container 1 by way of a flexible dip tube 7.

In all of the alternative embodiments, an upright cup or thimble-shaped refill preventing connector 8 is connected to the container neck. Connector 8 comprises within the neck, a substantially frusto-conical side wall having a closed lower end, and at the closed end of the connector 8 there is, also within the neck, and substantially at the level where the neck is connected with body 1 of the container, a cylindrical fitting 9 coaxial with the side wall and constituted by an upper part **9*a* into which the end of the suction tube 6 is force-fitted, and a lower part 9*b* into which the upper end of dip tube 7 is engaged. Parts 9*a* and 9*b* of fitting 9 intercommunicate through an orifice 10. The connector 8 includes near the bottom of the side wall, an orifice 11, allowing communication between the interior of the container body and the gas space between the wall of connector 8 and the pump barrel 5. The body of container 1, its neck, the connector 8 and the cap 2** are all made from moulded plastics material.

Figure 1:
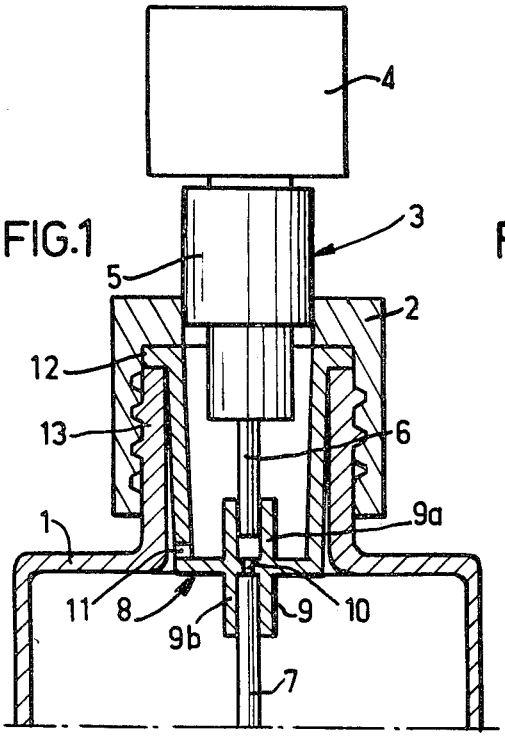

Referring now to the embodiment shown in FIG. 1, it will be seen that the connector 8 comprises around its rim at the top, a flat collar or flange 12 which is bonded, for example by welding, to the top edge of the end of a container neck 13. Neck 13 carries an external thread which cooperates with an internal thread formed on cap 2. It is clear that if cap 2 is unscrewed, the container 1 remains obturated by the connector 8 which is bonded to the neck.

Figure 2:
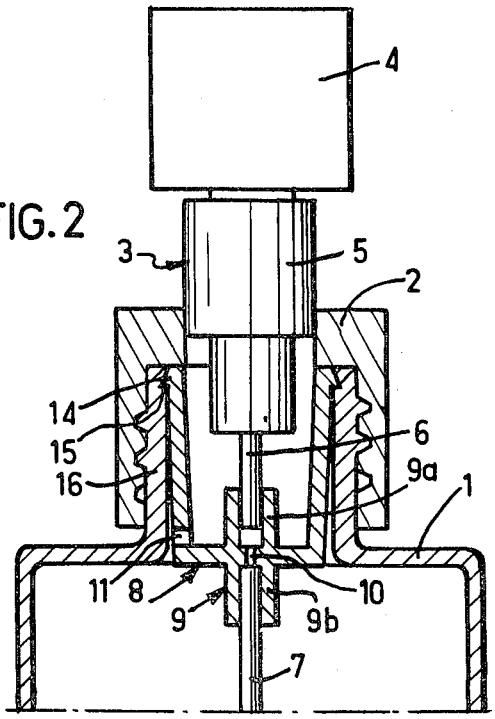

Referring to FIG. 2, it will be seen that connector 8 comprises at its upper part, a collar 14 whose cross section is trapezoidal, the base of the trapezium facing towards the bottom of the connector. This collar 14 cooperates with a groove 15 formed on the inside wall of a container neck 16 along the end edge of the neck. The cooperation of collar 14 and groove 15 allows connector 8 to be very firmly engaged within neck 16. Neck 16 comprises an external or male screw thread which cooperates with the internal thread of cap 2. Here again, if pump 3 and its associated cap 2 are removed, container 1 remains closed by the connector 8 which, as in the preceding case, is very difficult to extract from the neck.

Figure 3:
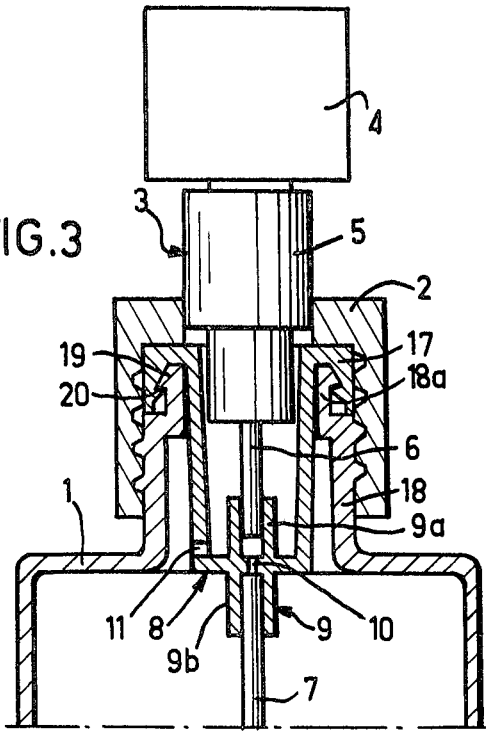

In FIG. 3, the rim at the open end of the cup shaped or "thimble" connector 8 forms a double right angled turn and thus constitutes an annular stirrup 17 positioned over the free end **18*a* of the neck 18. The free end 18*a* has a diameter smaller than that of the base of neck 18. This end 18*a* of the neck comprises an engaging rim 19 which cooperates with a correspondingly shaped groove 20 formed on the inner wall of the annular stirrup which surrounds neck end 18*a*. The thread of cap 2 is carried by the lower part of neck 18. If, with this embodiment, the user tries to remove connector 8 from the neck, he or she will find it difficult to determine how the connector is fixed on the neck and is likely to damage the neck 18 completely before removing the connector. This allows the desired result to be obtained of preventing the container 1** from being refilled after its first use.

In the embodiment of FIG. 4, the connector 8 is exactly the same as the one described for the embodiment of FIG. 1, but its fixing to container neck 21 is no longer effected by bonding. The upper part **21*a* of container neck 21 has external and internal diameters smaller than those of the lower part of neck 21; the upper rim of this part 21*a* of the container constitutes a flange 22 on which rests the collar 12 of connector 8. Collar 12 is held in position of flange 22 by means of a retaining cap 23 which has an opening at its center to allow the barrel of pump 5 to be received therein. The lower part of neck 21 carries the external thread which cooperates with the internal thread of cap 2**.

Figure 5:
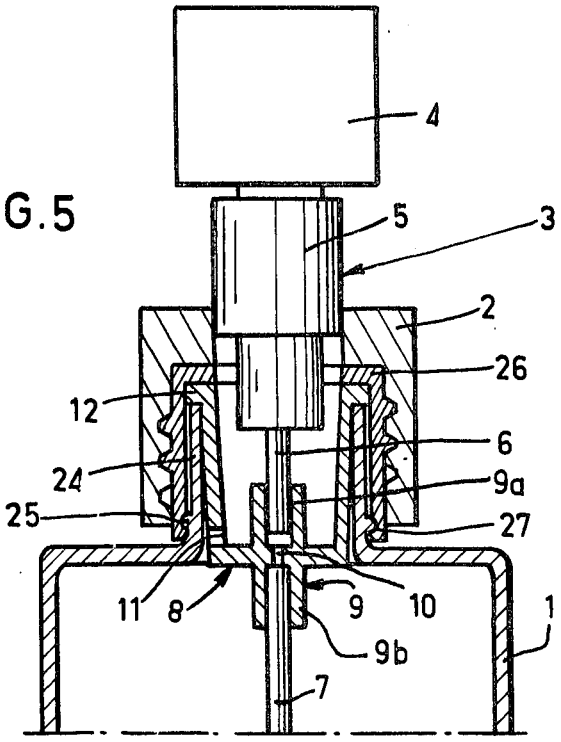

In the alternative embodiment of FIG. 5, connector 8 has exactly the same shape as that of the embodiments of FIGS. 1 and 4. The container neck is constituted by a cylindrical sleeve 24 comprising, on its lower end, an engaging catch bead 25. An outer cap 26 is arranged around the outside of this sleeve 24. The main closure of the container is the cap 2 common to FIGS. 1 to 5. The outer cap 26 covers collar 12 of connector 8 and is held in position, to ensure the fixing of connector 8 in the neck, by catch engagement of bead 25 in a groove 27 formed in the lower end of cap 26. In the central zone of its end wall, the cap 26 comprises an opening allowing barrel 5 of pump 3 to pass through. This alternative also makes it possible to conceal from the user's view the mode of fixing for connector 8. In this embodiment, the external thread for cooperating with the internal thread of outer cap 2 is carried by the side wall of outer cap 26 and thus, in order to avoid a relative rotation of cap 26 around sleeve 24, striations are arranged internally on inner cap 26 and/or externally on sleeve 24 to grip the two parts frictionally together.

Figure 6:
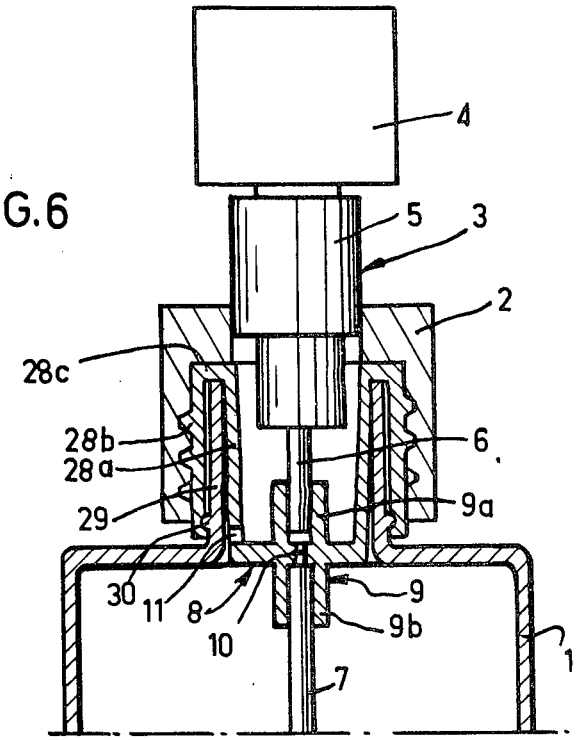

The alternative embodiment shown in FIG. 6 has the side wall of the thimble or cup constituting connector 8, formed by two coaxial shells, designated as **28*a* for the internal shell and 28*b* for the outer shell. Shells 28*a* and 28*b* are connected along the open end of the thimble by a flat collar 28*c*. The container neck, here referenced 29, is constituted by a single cylindrical wall comprising at its lower end, an external catch bead 30. The radial distance between shells 28*a* and 28*b* is such that the container neck 29 may be inserted between them and that the positioning of connector 8 on neck 29 is ensured by the engagement of catch bead 30 in an appropriate groove formed on the inner wall of shell 28***b*. Shell 28*b* carries on its outside, a thread which cooperates with the internal thread of main cap 2. In this embodiment, as in the preceding case, provision is made for striations on neck 29, or between the two shells 28*a* and 28*b*, to avoid relative rotation between the connector 8, on to which cap 2 is screwed, and the neck 29. Again, in this embodiment, it is very difficult for the user to appreciate or determine how connector 8 is fixed to the container and thus the extraction or removal of connector 8 and hence, the reuse of container 1 is practically impossible.

In all the embodiments described above, the connector 8 obturates the container neck and allows refilling only by means of orifices 10 and 11 which will be manifestly inadequate to allow the container to be refilled. Before sale, the container 1 will of course have been filled before the connector 8 has been attached. The pump 3 attached to cap 2 may therefore be removed and reused without thereby risking an inopportune refilling of the container.

What is claimed is:

1. A device for storing and dispensing a liquid product, comprising: a container having a neck; means for effectively preventing refilling of the container comprising, a connector, and means fixing said connector to said neck; a manually operable dispensing pump removably mounted on said container, said pump having an inlet; and cooperating means on said pump and said connector for connecting the inlet of the pump to the interior of the container to dispense a liquid product from the container in response to operation of the pump.

2. A device according to claim 1 wherein said means fixing said connector to said neck comprises means fixing the connector to the neck against removal except by damaging either the container or the connector.

3. A device according to claim 1 wherein said connector has an air vent orifice for venting between an air space in the container and a space between the pump and the connector.

4. A device according to claim 1 wherein said connector comprises a cup shaped body having an open upper end positioned within said neck, said body having a radially extending flange adjacent its open end seated adjacent the rim of the neck of the container.

5. A device according to claim 4 wherein said means fixing said connector to said neck comprises, means bonding said flange of the connector to said rim of the container neck.

6. A device according to claim 4, wherein said flange of said connector engages the rim of said container neck, and said means fixing said connector to said neck comprises, a retaining cap extending over said collar and on said neck.

7. A device according to claim 4 wherein said cup shaped body has a bottom wall, and said cooperating means on said pump and said connector comprise a fitting on said connector projecting into the body of the connector, and an inlet tube connected to the inlet of said pump, said tube and pump being dimensioned to be force fitted together to connect the pump inlet to the interior of the container.

8. A device according to claim 7 wherein said connector comprises a moulded plastic material component having a height substantially the same as that of the neck of the container, said body of the connector comprising a surface of revolution centered on the axis of said fitting.

9. A device according to claim 7 wherein said flange of the connector body comprises a collar having a cross section of increasing diameter toward the interior of said container, said container neck having a correspondingly shaped groove in its inner wall adjacent the rim of the neck, said collar and groove forming said means fixing the connector to said neck.

10. A device according to claim 7 wherein said connector further comprises a downwardly extending collar on said flange, said collar overlapping the rim of said container neck, and said means fixing said connector to said neck comprises, cooperating flange and groove means on said collar and the rim of said neck.

11. A device according to claim 7, further comprising a fitting on the connector projecting into the interior of the container, said bottom wall of said connector having therein a small orifice via which said fittings communicate with each other through said bottom wall.

12. A device according to claim 11, further comprising a dip tube extending into said container and fixed to said fitting which projects into the container.

13. A device according to claim 1 further comprising an internally threaded cap, said pump being fixed to said cap, and the thread of the cap cooperating with an external thread of the container neck to connect the pump to the container.

14. A device according to claim 13 wherein said external thread of the container neck is on an outside face of the wall of the container neck.

15. A device according to claim 1 wherein said container neck comprises an inner sleeve integral with said container, and a neck cap surrounding said inner sleeve, said connector comprising a cup shaped body having a collar at its upper open end disposed between a rim of said inner sleeve of the neck and a flange of said neck cap, said neck cap comprising said means for fixing said connector to said neck.

16. A device according to claim 15 wherein said neck cap further comprises, means for connecting said pump to said container.

17. A device according to claim 1 wherein said connector comprises an inner cup shaped body, an outer shell, and an integral flange connecting the upper end of said body to the upper end of said shell, said container neck comprising a sleeve extending between said body and said connector shell, and said means fixing said connector to said neck comprises cooperating groove and recess means on said connector and said neck.

18. A device according to claim 17 wherein said outer shell of said connector includes means for connecting the pump to the container.

19. A device according to claim 18 wherein said means for connecting the pump to the container comprises a cap secured to said pump, and cooperating threads between said cap and said outer shell for threading said pump on said container.

* * * * *